United States Patent [19]

Slattery et al.

[11] 4,320,711

[45] Mar. 23, 1982

[54] TUFTING APPARATUS FOR FORMING LOOP AND CUT PILE

[75] Inventors: Ian Slattery, Hixson, Tenn.; Wheeler E. Phillips, Kensington, Ga.

[73] Assignee: Spencer Wright Industries, Inc., Chattanooga, Tenn.

[21] Appl. No.: 266,962

[22] Filed: May 26, 1981

[51] Int. Cl.[3] ..... D05C 15/00

[52] U.S. Cl. ..... 112/79 R; 112/79 A

[58] Field of Search ..... 112/79 R, 79 A, 79.5, 112/78, 266.2, 79 FF

[56] References Cited

U.S. PATENT DOCUMENTS

| | | | |
|---|---|---|---|
| 3,084,645 | 4/1963 | Card | 112/79 R |
| 3,919,953 | 11/1975 | Card | 112/79 R |
| 4,134,347 | 1/1979 | Jolly et al. | 112/79 R |
| 4,185,569 | 1/1980 | Jolly et al. | 112/79 R |
| 4,285,288 | 8/1981 | Inman et al. | 112/79 R |

*Primary Examiner*—H. Hampton Hunter

*Attorney, Agent, or Firm*—Alan Ruderman

[57] ABSTRACT

A cut pile tufting machine having cut pile hooks and cooperating knives pointing in the direction oppositely to the direction in which base material is being fed includes loop pile loopers in a selective array in the same mounting member as the cut pile hooks and pointing in the direction oppositely to that in which the fabric is being fed. A wiper cooperates with each loop pile looper to push loops of yarn seized by the looper off the beak of the looper to form loop pile. The wipers are mounted in knife blocks with the knives and rock into loop pushing relationship with the loop pile loopers as the knives rock into cutting engagement with the loops on the cut pile hooks. The loopers have an elongated inclined blade terminating at the beak which is spaced below the cutting edge of the hook relatively to the base material. Yarn feed rolls feed less yarn to the needles that cooperate with the loopers than required so that as each loop is formed the preceeding loop is backrobbed to the same level as the cut pile.

5 Claims, 3 Drawing Figures

TUFTING APPARATUS FOR FORMING LOOP AND CUT PILE

BACKGROUND OF THE INVENTION

This invention relates to tufting machines and more particularly to tufting apparatus for forming selective rows of loop pile stitching in a cut pile tufting machine.

In a tufting machine a plurality of rows of yarn carrying needles are reciprocably driven through a base fabric fed through the machine to form loops to be seized by loopers oscillating below the fabric in timed relationship with the needles as the loopers cross the needles just above the needle eye. In loop pile machines the loopers point in the direction in which the base fabric is being fed, and hold the seized loops while the needles are being retracted from the fabric, thereafter moving away from the point of seizure to release the loop. In conventional cut pile machines the loopers (or hooks) point in the direction opposite to the direction of fabric feed so the loops feed into the loopers and each looper cooperates with a respective oscillating knife. Since the loops are being fed toward the closed end of the looper they cannot be released except by being cut by the knife. As the looper rocks away from the point of loop seizure the knife rocks upwardly and cuts the loop between the top edge of the knife and the bottom edge of the looper.

It is known to form spaced rows of cut pile and loop pile in a tufting machine by a number of methods. For example, in Card U.S. Pat. No. 3,084,645 cut pile and loop pile in the same row of stitching can be formed selectively using a looper pointing in the direction oppositely to fabric feed, the looper having a spring clip which permits a loop to be withdrawn from the looper by backdrawing yarn to force the clip away from the looper. The loops withdrawn remain uncut while those loops that remain on the looper are cut. A yarn feed pattern attachment must be utilized to effect selectively the backdrawing. Thus, although each row of stitching may be controlled to form either cut pile or loop pile, this apparatus, because of the backdrawing, produces uncut loops having a pile height shorter than the cut pile produced.

In Card et al U.S. Pat. No. 3,919,953 a tufting machine is disclosed in which adjacent rows of loopers point in the opposite direction to each other to form alternate rows of cut pile and loop pile. The rows of loopers which produce loop pile point in the same direction in which the base fabric is being fed, while the hooks in the rows producing cut pile point in the opposite direction and cooperate with a respective knife. Thus, although mounted in a single tufting machine bed, the loop pile producing members and the cut pile producing members operate in conventional manner and can be positioned below the bedplate to produce even level cut and loop pile. The difficulty presented, however, is that two looper bars are required, one slotted for the loop pile loopers and the other for the cut pile loopers. Thus, if a fabric having anything but a row of cut pile intermediate each row of loop pile is desired, it cannot be produced by this apparatus.

In Jolley et al U.S. Pat. No. 4,134,347 and Inman U.S. Pat. No. 4,185,569 tufting machines are illustrated in which level cut pile and loop pile may be formed in the same row of stitching selectively, and thus each row may form either cut pile or loop pile. These machines utilize gate controlled loopers for selectively opening and closing passage of a loop onto the blade of the looper, and although they provide versatile patterning capabilities their sophistication may not be warranted where the type of pile in a given row remains basically fixed.

In Ingram et al copending U.S. application Ser. No. 174,119 filed July 31, 1980, and commonly assigned to the assignee of the present invention, a uniquely designed looper is disclosed which seizes and thereafter releases a loop when pointing in the direction oppositely to the direction the base material is being fed, i.e. when installed in a cut pile tufting machine. Such a looper can be used to form selective arrays of loop pile and cut pile rows.

SUMMARY OF THE INVENTION

The present invention provides selective rows in a cut pile tufting machine with a loop pile looper similar to the looper in the aforesaid application of Ingram et al pointing in the direction oppositely to the direction the base material is being fed and includes a pusher member for pushing the loops off the loop pile loopers, the pusher members being carried in the knife holder with the knives that cut loops on the cut pile hooks. Thus, the pusher members move with the knives and as the knives move into cutting relationship with the cut pile hooks to cut loops thereon, the pusher member pushes the loops off the loop pile loopers. Thus, any selective array of loop pile and cut pile rows may be produced inexpensively in a conventional cut pile tufting machine merely by replacing the conventional cut pile hooks in selective rows with the new loop pile loopers and replacing the knives in those rows with the pusher members.

In practicing the principles of the present invention the loop pile looper has an elongated upwardly inclined beak extending from a throat and the pusher is a knife-like member having a beak engaging protuberance for pushing the loop off the beak as the looper rocks away from the needle path and as the pusher rocks with the knives. Thus, the scissors-like action of the knives cut loops on the cut pile hooks and the pushers eject loops on the loop pile loopers. The beaks of the loop pile loopers may be disposed below the cutting edge of the loop pile hooks so the loops can be controllably back-robbed to the level of the cut ends of the cut pile.

Consequently, it is a primary object of the present invention to provide tufting apparatus for forming selective rows of loop pile stitching and cut pile stitching in a conventional cut pile tufting machine.

It is another object of the present invention to provide in a cut pile tufting machine novel loopers in selective rows for seizing loops from respective needles and pusher members which rock into cooperation with the loopers to eject the loops from the loopers as the loopers rock away from the needle path.

BRIEF DESCRIPTION OF THE DRAWINGS

The particular features and advantages of the invention will become apparent from the following description taken in connection with the accompanying drawings, in which.

DESCRIPTION OF THE PREFERRED EMBODIMENT

Figure 1:
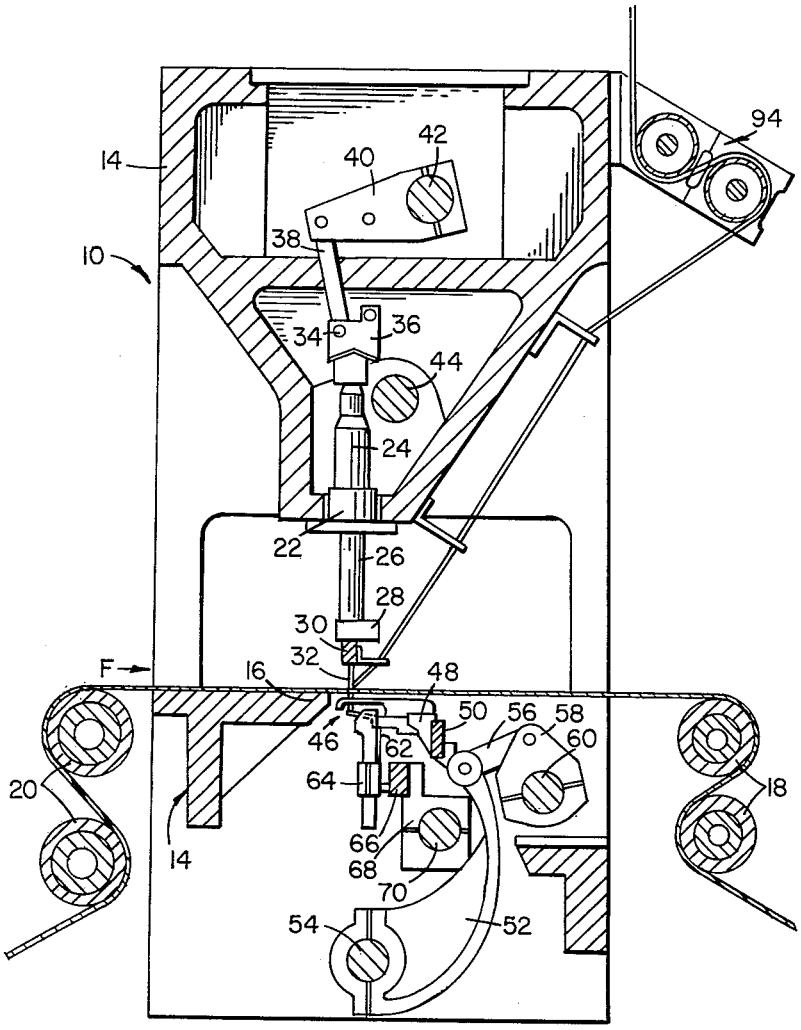
FIG. 1 is a vertical cross sectional view taken transversely through a cut pile tufting machine incorporating looper and pusher members constructed in accordance with the principles of the present invention and disposed intermediate conventional cut pile hooks and knives respectively for forming alternate rows of cut pile and loop pile fabric.

Referring now to the drawings, there is illustrated in FIG. 1 a conventional cut pile tufting machine 10 having a frame comprising a bed 12 and a head 14 disposed above the bed. The bed 12 includes a bedplate 16 across which a backing fabric F is adapted to be fed by a pair of feed rolls 18 and take-off rolls 20.

Mounted in the head 14 are a plurality of collars 22 (only one of which is shown) for supporting a respective sleeve 24. Reciprocably mounted within each sleeve is a push rod 26, to the lower end of which a needle bar carrier 28 is attached and which in turn supports the needle bar 30 that carries a multiplicity of needles 32. The upper end of the push rod 26 is connected by a wrist pin 34 to a connecting member 36 which in turn is connected by a link 38 to a rock arm 40 on a rock shaft 42. Rocking motion is supplied to the shaft 42 by conventional means such as from a cam shaft 44 as is notoriously well known in the art. Briefly, however a circular cam is eccentrically fixed to the shaft 44 and drives a lever fixed to the shaft 42 through a connecting rod. Rotational motion of the shaft 44 is thus converted into rocking motion at shaft 42 to reciprocate the push rods 26, the needle bar 30 and the needles 32.

Mounted in the bed 12 for cooperation with the needles to seize loops of yarn presented thereby are a plurality of loopers or hooks generally indicated at 46 and comprising conventional cut pile hooks intermediate novel loopers, all of which point in the direction oppositely to the direction in which the fabric F is fed and to which further reference will be made. For clarity of presentation, although the terms hooks and loopers may be used inter-changeably, loopers herein refer to the loop pile loop seizing members and hooks refer to the cut pile loop seizing members. All the hooks and loopers however have conventional planar shanks or mounting portions positioned in slots in a hook or looper bar or as illustrated a number of such members may be disposed in a unitary module 48 carried by a mounting bar 50 secured to the upper end of a rocker arm 52. Conventionally the rocker arm 52 may be oscillated by a rock shaft 54 clamped at the lower end of the arm and journalled in the bed. Pivotably connected to the upper portion of the rocker arm is one end of a connecting link 56 having its other end pivotably connected between forked arms of a jack shaft rocker arm 58 which in turn is clamped to a jack shaft 60 oscillated by conventional drive means from the shaft 44 in timed relationship with the reciprocation of the needles.

A plurality of knives 62 respectively cooperate with each of the cut pile hooks to cut the loops seized thereon to form cut pile. The knives are mounted in knife blocks 64 secured to a knife bar 66 which in turn is secured to a knife shaft rocker arm 68 clamped to a rocking knife shaft 70. Oscillatory movement is imparted to the knife shaft 70 to conventionally drive the knives into engagement with one side of the respective cut pile hooks to provide a scissors-like cutting action to cut the loops thereon.

Figure 2:
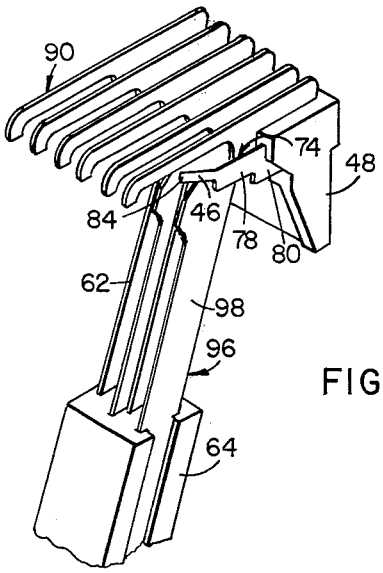
FIG. 2 is a perspective view of a looper and hook module and a knife and pusher block illustrated in FIG. 1.
Figure 3:
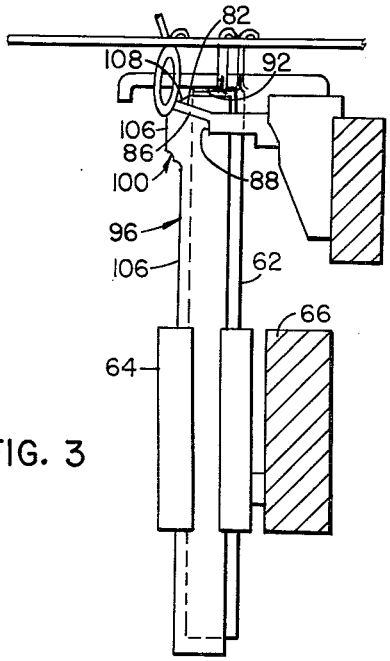
FIG. 3 is an elevational view illustrating the action of the pusher member in ejecting a loop from the looper.

Referring now to FIGS. 2 and 3, the loop pile looper 74 of the present invention comprises a planar member having a body portion including a blade 76 and a shank 78 including a mounting portion 80 at the rear thereof which is positioned in the module 48 or in a looper bar slot. The blade 76 extends forwardly from the shank along edge 82 and terminates at its upper leading edge in a beak 84. The lower edge 86 of the blade is inclined downwardly and rearwardly, the angular inclination of the edge 86 aiding in allowing the loop to shed from the beak. At the rear of the edge 86 the blade has an edge 88 that extends downwardly abruptly to define a throat and forms the leading edge of the shank 78.

The loopers 74 may be secured in the modules or mounted in a looper bar in any selected array with conventional cut pile hooks 90. In the form illustrated in the drawings there is a looper 74 intermediate each hook 90 so that alternate rows of cut pile and loop pile may be formed. Moreover, in the form disclosed each row forms the appropriate pile at the same level below the needle plate so that the pile height of the cut and loop pile is the same. The pile height of the cut pile conventionally is formed at the edge 92 of the cut pile hook 90, that edge being where the respective knife cuts. To form loop pile at the same level, the beaks 84 of the loopers 74 are disposed below the edge 92 of the hooks 90 and the shed loops are pulled back to the level of the edge 92 when the stitch is set. The pull-back is controlled by yarn feed means such as yarn feed rolls 94 which feed a supply of yarn to the needles that cooperate with the loopers only sufficient to form loops at the level of edge 92. Thus, in the formation of a loop by the needle and the seizing thereof by the loopers 74, yarn must be pulled-back or backrobbed from the previously formed loop. The previously formed loop is thus pulled-back to the level of the edge 92.

To shed each loop from the loopers 74 the present invention provides a pusher member or wiper 96 which acts against the surface of the respective looper blade 76 and moves in conjunction with the movement of the loopers to push or wipe each loop in succession from the blade and off the beak 84 of the looper. Preferably, as illustrated, the pusher members are similar to the knives 62 and are carried in knife blocks. With alternate cut and loop, as illustrated, a common knife block 64 carries knives 62 and wipers 96 in alternate channels of the block. The pushers may be wider than the knives for wiping across the blade, but to maintain the shanks 98 equal to those of the knives so that common knife block channels can accept both, the pusher is provided with a protuberance 100 at the leading edge which extends beyond the leading edge 102 of the shanks 98. The leading edge 106 of the protuberance at the upper part is raked rearwardly at a forty five degree angle 108. This raked or inclined portion 108 is substantially the same length as the blade 76 of the looper 74 from the beak 84 to the edge or throat 88 so that the edge of the portion 108 can engage the entire blade for wiping the seized loops. The knife blocks are conventionally inclined in the knife bar so that the knives contact the hooks with tension for cutting, and the pushers 96 similarly contact the loopers for wiping.

As the looper/hook modules rock toward and away from the needle center line the knife blocks also rock conventionally. At the rear of the stroke of the modules, the knives cut the loops on the hooks as the knives are rocked forwardly. At the same time the pushers wipe the uncut loops off the blade of the loopers, the rearward movement of the loopers together with the wiping action of the pushers ensure the release of the loops which are thereafter backrobbed to the level of the edge 92 as the needles reciprocate downwardly to the bottom of the next stroke.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention what is claimed herein is:

1. In a tufting machine, means for feeding a base material in one direction, first and second yarn-carrying needles for penetrating the base material and forming loops therein, means for feeding yarn to each of said needles, a hook disposed on the opposite side of the base material from said needles including a blade and a loop seizing free end facing in the direction opposite to the direction of material feed, means for mounting said hook for oscillatory movement toward and away from cooperation with said first needle so that said hook enters successive loops presented by said first needle, means for oscillating said knife into cooperation with the blade of said hook for severing loops thereon to form cut pile, a looper disposed on the opposite side of said base material from said needles including a loop seizing free end facing in the direction opposite to the direction of material feed, means for mounting said looper for oscillatory movement toward and away from cooperation with said second needle so that said looper enters successive loops presented by said second needle, a wiper, and means for oscillating said wiper into cooperation with the free end of said looper for pushing each loop seized by said looper off the free end thereof.

2. In a tufting machine as recited in claim 1, wherein said means for oscillating said knife and said means for oscillating said wiper include a common block for mounting said knife and said wiper.

3. In a tufting machine as recited in claim 2, wherein said free end of said looper is inclined relatively to the blade of said hook and terminates at a beak disposed closer to the blade than the remainder of said free end relatively to the base material, said beak being disposed further from said base material than said blade of said hook, and said means for feeding yarn to said second needle feed an amount sufficient only to form loops at the disposition of said blade, whereby each loop is backrobbed to said disposition during the formation of the next successive loop.

4. In a tufting machine as recited in claim 3, wherein said means for mounting said hook and said means for mounting said looper include a common mounting member.

5. In a tufting machine as recited in claim 4, wherein said wiper engages and moves across the entire free end of said looper.

* * * * *